US011840392B1

(12) United States Patent
Penic

(10) Patent No.: US 11,840,392 B1
(45) Date of Patent: Dec. 12, 2023

(54) GAG GIFT TAMPON CORK APPLICATOR

(71) Applicant: Caitlin Penic, Troy, OH (US)

(72) Inventor: Caitlin Penic, Troy, OH (US)

( * ) Notice: Subject to any disclaimer, the term of this patent is extended or adjusted under 35 U.S.C. 154(b) by 0 days.

(21) Appl. No.: 17/841,466

(22) Filed: Jun. 15, 2022

(51) Int. Cl.

| | |
|---|---|
| ***B65D 81/36*** | (2006.01) |
| ***B65D 39/16*** | (2006.01) |
| ***B65D 39/12*** | (2006.01) |
| ***B65D 39/00*** | (2006.01) |

(52) U.S. Cl.
CPC ..... *B65D 81/365* (2013.01); *B65D 39/0058* (2013.01); *B65D 39/12* (2013.01); *B65D 39/16* (2013.01)

(58) Field of Classification Search
CPC .. B65D 81/365; B65D 81/36; B65D 39/0058; B65D 39/0052; B65D 39/12; B65D 39/16; B65D 2543/00546; A47G 19/2227; A45C 11/008
USPC ..... 215/358, 361, 364, 355; 220/234, 233, 220/720, 801, 800; 206/581, 223; 604/904
See application file for complete search history.

(56) References Cited

U.S. PATENT DOCUMENTS

2003/0003023 A1* 1/2003 Korpela ..... B01L 3/50825 215/361
2016/0355302 A1* 12/2016 Hatamian ..... B65D 39/12

FOREIGN PATENT DOCUMENTS

EP 1184295 B1 * 3/2004 ..... B65D 39/12

* cited by examiner

*Primary Examiner* — Robert J Hicks
(74) *Attorney, Agent, or Firm* — Lyman Moulton, Esq.; Moulton Patents, PLLC

(57) ABSTRACT

The wine-pon is the only product of its kind that connects the same ideology between corking a bottle and the functional practice of using a disposable hygiene product. This unprecedented device is uniquely designed to be the exact size and shape of a traditional tampon allowing it to complement any bottle size and it will come in various applicator colors, similar to the tampons available in the market, to appeal to consumer preferences.

12 Claims, 2 Drawing Sheets

GAG GIFT TAMPON CORK APPLICATOR

BACKGROUND

On many occasions, individuals may often be left with an opened bottle or two of wine or champagne. Preserving the exotic flavors, carbonation, and/or overall quality of the opened and unused bottles, however, can be challenging when the original bottle cork or a supplement option is not available. There have been no products available as original equipment or as an aftermarket to address this problem.

An apparatus to help seal up unused wine or champagne to preserve the quality of the drink and serve as a fun gag gift is not being met by any known device or system at present. There have been no products available as original equipment or as an aftermarket to address this problem either.

SUMMARY OF THE INVENTION

The main purpose of the gag gift tampon cork applicator is to provide users with a wine bottle cork that looks and operates like a tampon, that will serve as a kitchen accessory and a "gag-gift".

A bottle cork device disclosed comprises a plunger applicator and a barrel configured to receive the plunger applicator therein and to be slidingly received into a mouth of the bottle. The bottle also includes a cork configured to be slidingly received into the barrel past a tip thereof and expand to seal with a neck of the bottle. The disclosure further includes a string attached to the cork through the plunger applicator and extend beyond the mouth of the bottle.

Figure 1:
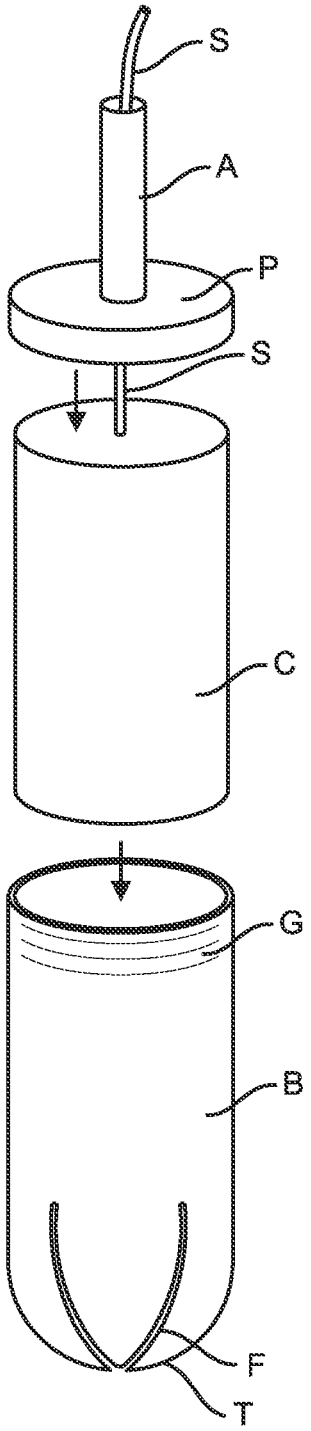
FIG. 1 is a front perspective view of the dissembled gag gift tampon cork device in accordance with an embodiment of the present disclosure.

Throughout the description, similar reference numbers may be used to identify similar elements depicted in multiple embodiments. Although specific embodiments of the invention have been described and illustrated, the invention is not to be limited to the specific forms or arrangements of parts so described and illustrated. The scope of the invention is to be defined by the claims appended hereto and their equivalents.

DETAILED DESCRIPTION

Reference will now be made to exemplary embodiments illustrated in the drawings and specific language will be used herein to describe the same. It will nevertheless be understood that no limitation of the scope of the disclosure is thereby intended. Alterations and further modifications of the inventive features illustrated herein and additional applications of the principles of the inventions as illustrated herein, which would occur to one skilled in the relevant art and having possession of this disclosure, are to be considered within the scope of the invention.

FIG. 1 is a front perspective view of the dissembled gag gift tampon cork device showing: a string S, a push applicator referenced as P which is a soft flexible material in different colors, a push applicator neck A, a cork referenced as C, a barrel B with a tip T and fissures F and a finger grip G, in accordance with an embodiment of the present disclosure.

Figure 2:
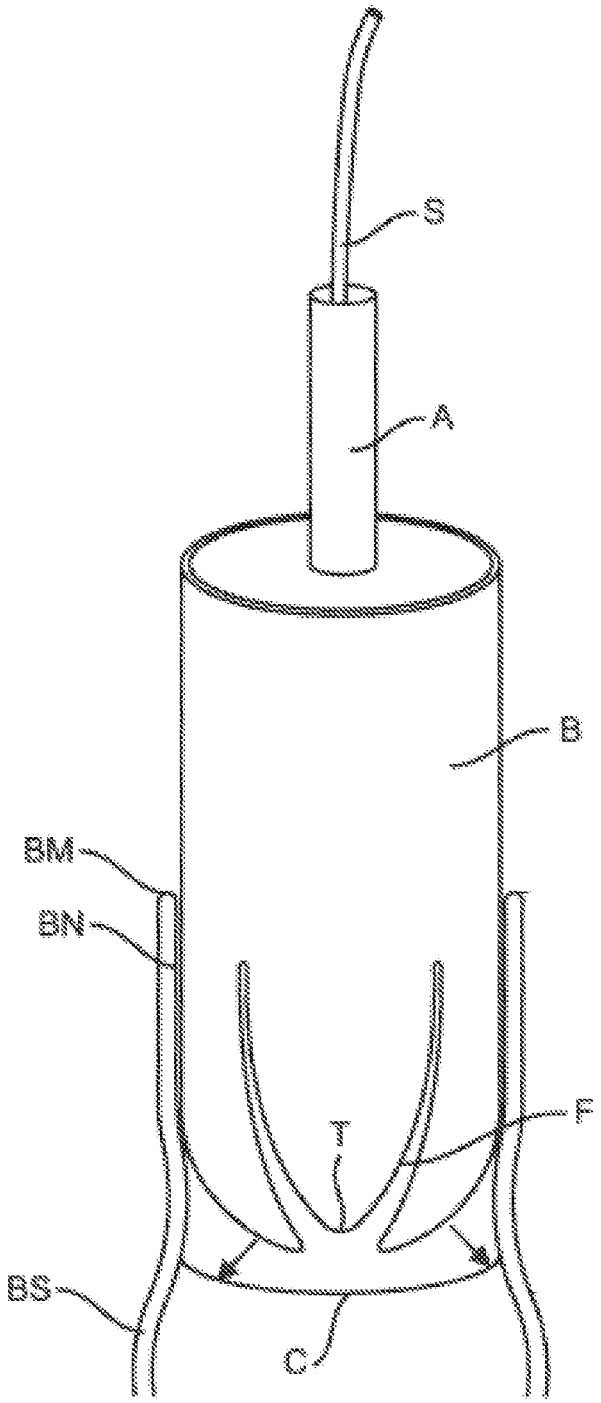
FIG. 2 is a front perspective view of the assembled gag gift tampon cork applicator in accordance with an embodiment of the present disclosure.

FIG. 2 is a front perspective view of the assembled gag gift tampon cork device showing the same limitations as in FIG. 1 but inside a bottle in accordance with an embodiment of the present disclosure. The view therefore shows the bottle mouth BM, the bottle neck BN and the bottle shoulder BS. The fissures F are shown spread apart by the pressure of the cork C shown just penetrating and passing through the fissures F at the tip T of the barrel. The tip T forks at the fissures F and creates a friction fit of the barrel B inside the bottle and fixes it therein.

Therefore the disclosure acts as a cap to a liquid in the bottle and looks similar to an inserted tampon. The cork C is slidingly received in the barrel B so it can be removed therefrom by the string S and yet the barrel B remains in the mouth of the bottle BM. Embodiments without the fissures F are included where the barrel B has a textured surface to stay inside the bottle mouth BM and the bottle neck BN even without a presence of the cork C depending on respective coefficients of friction between the barrel B and the bottle and the cork C.

The present disclosed gag gift tampon cork applicator, also known as the "Wine-Pon" offers a modern accessory that provides users with a funny gift or gadget that prevents leftover alcoholic beverages from going flat, permitting the user to enjoy the drink at later times; thus, improving the drinking experience. Expanding on the initial concept of a tampon, the wine-pon introduces a novel cork that is inserted into a primary applicator and then inserted into the wine bottle, in the exact way that a tampon is used with respect to disposable hygiene practices. Once the applicator is inserted into the bottle, the cork will expand to the neck of the bottle thereby preventing further oxidation. When the user is ready to pour from the bottle, at a later time, they would simply remove the cork and save it for reuse, when required. The wine-pan offers a quirkier yet more effective means of preserving wine and champagne as it keeps their distinctive fruity notes and/or carbonation fresh, for days. This innovative, top-quality product can be given as a novelty gift or used to benefit all homeowners who seek to have a more efficient means of corking their bottles.

Although the operations of the method(s) herein are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

What is claimed is:

1. A bottle cork device for a bottle, and comprising:

a plunger applicator;

a barrel configured to receive the plunger applicator therein and to be slidingly received into a mouth of the bottle;

a cork configured to be slidingly received into the barrel past a tip thereof and expand to seal with a neck of the bottle; and a string attached to the cork through the plunger applicator and extending beyond the mouth of the bottle.

2. The bottle cork device of claim 1, further comprising a neck extending from an open side of the plunger and configured as a finger grip for the plunger applicator.

3. The bottle cork device of claim 1, further comprising a neck extending from an open side of the plunger applicator and configured as a guide for the string.

4. The bottle cork device of claim 1, wherein the string is configured to enable pulling the cork therewith out of the barrel and the bottle.

5. The bottle cork device of claim 1, wherein the barrel comprises a pointed tip comprising a plurality of closed fissures therein.

6. The bottle cork device of claim 1, wherein the barrel comprises a plurality of fissures in a tip thereof configured to allow a passage of the cork therethrough.

7. The bottle cork device of claim 1, wherein the plunger applicator is a disk having an outside diameter less than an inside diameter of the barrel.

8. The bottle cork device of claim 1, wherein the cork is a cylinder having an outside diameter less than an inside diameter of the barrel.

9. The bottle cork device of claim 1, wherein an outside diameter of the plunger applicator is equal to an outside diameter of the cork.

10. The bottle cork device of claim 1, wherein an outer surface of a topside of the barrel comprises a plurality of ridges configured as a finger grip surface.

11. The bottle cork device of claim 1, wherein an outside surface of the barrel is textured so a coefficient of friction thereof is greater than an inside surface coefficient of friction of the barrel to allow the cork to slide therefrom and the barrel to stay fixed in the bottle.

12. The bottle cork device of claim 1, wherein an expansion of a plurality of fissures in a tip of the barrel by a passage of the cork creates a plurality of fork structures in the tip which form a seal with an inside surface of the bottle.

* * * * *